US007837864B2

(12) United States Patent
Reynolds

(10) Patent No.: US 7,837,864 B2
(45) Date of Patent: Nov. 23, 2010

(54) PROCESS FOR EXTRACTING BITUMEN USING LIGHT OIL

(75) Inventor: Bruce E. Reynolds, Martinez, CA (US)

(73) Assignee: Chevron U. S. A. Inc., San Ramon, CA (US)

( * ) Notice: Subject to any disclaimer, the term of this patent is extended or adjusted under 35 U.S.C. 154(b) by 219 days.

(21) Appl. No.: 12/004,052

(22) Filed: Dec. 20, 2007

(65) Prior Publication Data

US 2009/0159506 A1 Jun. 25, 2009

(51) Int. Cl.
*C10G 1/04* (2006.01)

(52) U.S. Cl. ..... 208/391; 208/390; 208/49; 208/107; 208/108

(58) Field of Classification Search ..... 208/391
See application file for complete search history.

(56) References Cited

U.S. PATENT DOCUMENTS 4,427,535 A * 1/1984 Nongbri et al. ..... 208/112
5,484,755 A 1/1996 Lopez
6,096,192 A * 8/2000 Myers et al. ..... 208/108
6,454,932 B1 9/2002 Baldassari et al.
6,726,832 B1 4/2004 Baldassari et al.
6,841,062 B2 1/2005 Reynolds
7,214,309 B2 5/2007 Chen et al.
2006/0054534 A1 3/2006 Chen et al.
2006/0054535 A1 3/2006 Chen et al.
2006/0058174 A1 3/2006 Chen et al.
2006/0058175 A1 3/2006 Chen et al.
2006/0144754 A1 * 7/2006 Van Den Bosch et al. ... 208/106
2007/0025899 A1 2/2007 Marcantonio
2007/0045155 A1 * 3/2007 Selmen et al. ..... 208/49
2007/0138055 A1 6/2007 Farshid et al.
2007/0138057 A1 6/2007 Farshid et al.
2008/0156700 A1 7/2008 Abulnaga et al.

FOREIGN PATENT DOCUMENTS

EP 1273649 A2 * 1/2003

* cited by examiner

*Primary Examiner*—Glenn A Caldarola
*Assistant Examiner*—Michelle L Stein

(57) ABSTRACT

An integrated process for extracting and refining bitumen comprises hydroconverting bitumen in a reactor to provide valuable products and light oil by-product; separating the light oil by-product from the valuable products; transporting the light oil to oil sands reserves; producing steam in steam generators at the oil sands reserves using a portion of the light oil transported to the oil sands reserves; extracting bitumen from the oil sands reserves using steam produced in the steam generators; blending bitumen extracted from the oil sands reserves and a portion of the light oil transported to the oil sands reserves to form a transport blend; and transporting the transport blend to the reactor.

17 Claims, No Drawings

PROCESS FOR EXTRACTING BITUMEN USING LIGHT OIL

BACKGROUND

Many oil sands reserves, for example, those in the Athabasca region of Alberta, Canada, are too deep to be economically surface mined. The oil in the oil sands is very heavy and viscous, so it will not flow to the surface without some heating or solvents or both. One way that the oil in the oils sands can be produced is by Steam Assisted Gravity Drainage (SAGD), which involves putting a great deal of steam into the underground oil sands deposit through horizontal laterals to heat the oil and then collecting the oil in a second set of laterals positioned lower than the first set of laterals (hence the collection by gravity based drainage). Oil sands often covers a huge area (e.g., thirty km by seventy km) and injection/producer well pairs can be located one km or more apart.

Additionally, oil sands reserves are often located in wilderness areas with very few or no roads. Limited infrastructure in the area can be overwhelmed with oil sands operations (mostly mining and upgrading based), which can lead to severe shortages of water, natural gas (for steam production), and human resources to support such developments. Accordingly, further development must do a better job of avoiding adverse environmental impact. For example, the size of the surface facilities "footprint" at the oil sands reserves must be minimized. However, upgrading (e.g., hydroconversion) facilities typical have a large footprint. Additionally, facilities that can produce steam without the use of natural gas generally have a large footprint, expensive environmental controls, and are not well suited to widely separated injection well locations.

What is needed is a more cost-effective and environmentally-friendly method of producing oil from oil sands reserves in areas where it is too expensive to burn natural gas to produce steam and/or environmental regulations preclude burning low value, high sulfur containing oils to produce steam.

SUMMARY

Provided is a process for extracting bitumen from oil sands reserves. The process comprises producing steam in steam generators at the oil sands reserves using light oil, heating the oil sands reserves using steam produced in the steam generators, and extracting bitumen from the oil sands reserves.

Further provided is a method for transporting bitumen from oil sands reserves. The method comprises blending bitumen extracted from the oil sands reserves and light oil to form a transport blend and transporting the transport blend. The light oil comprises hydrocarbons boiling in the range of about $C_5$ to about 800° F.

Additionally provided is a transport blend for transporting bitumen from oil sands reserves. The transport blend comprises about 50-60 volume % bitumen extracted from the oil sands reserves and about 40-50 volume % light oil. The light oil comprises hydrocarbons boiling in the range of about $C_5$ to about 800° F.

Also provided is an integrated process for extracting and refining bitumen. The process comprises hydroconverting bitumen in a reactor to provide valuable products and light oil by-product. The light oil by-product is separated from the valuable products. The light oil is transported to oil sands reserves. Steam is produced in steam generators at the oil sands reserves using a portion of the light oil transported to the oil sands reserves. Bitumen is extracted from the oil sands reserves using steam produced in the steam generators. Bitumen extracted from the oil sands reserves and a portion of the light oil transported to the oil sands reserves are blended to form a transport blend. The transport blend is transported to the reactor.

DETAILED DESCRIPTION

Provided is a more cost-effective and environmentally-friendly method of producing oil from oil sands reserves in areas where it is too expensive to burn natural gas to produce steam and/or environmental regulations preclude burning low value, high sulfur containing oils to produce steam.

Accordingly, a process for extracting bitumen from oil sands reserves as described herein comprises producing steam in steam generators at the oil sands reserves using light oil, heating the oil sands reserves using steam produced in the steam generators, and extracting bitumen from the oil sands reserves.

The light oil can comprise one or more fractions selected from the group consisting of naphtha, kerosene, diesel, and light vacuum gasoil. In particular, the light oil can comprise hydrocarbons boiling in the range of about $C_5$ to about 800° F. More specifically, the light oil can comprise greater than or equal to about 80 weight % hydrocarbons boiling in the range of about $C_5$ to about 650° F. In an embodiment, the light oil has a sulfur content of less than or equal to about 500 ppm or is sulfur-free.

The bitumen, extracted from the oil sands reserves, can comprise a heavy oil having an API gravity of 3 to 15. In an embodiment, the bitumen does not flow at room temperature. The light oil can be produced during hydroconversion of bitumen (e.g., whole bitumen, thus avoiding distillation costs). In particular, the hydroconversion can comprise reaction of a slurry of catalyst in the bitumen, for example, as described in U.S. Patent Application Publication Nos. 2006/0054534 A1, 2006/0054535 A1, 2007/0138055 A1, and 2007/0138057 A1, the contents of which are hereby incorporated by reference in their entireties. Alternatively, the hydroconversion can comprise LC-Fining or coking, following by hydrotreating, processes well known to one of skill in the art, as described in, for example, U.S. Pat. Nos. 6,454,932 and 6,726,832.

The steam generators for the injection/producer well pairs can be very similar in design to those used in heavy oil steamflood oil fields. Key features of such steam generators include their small size, efficient use of natural gas and water, and reliability, so that many of them can be located over large oil sands reserves next to individual well pairs. A major change in the steam generators, as compared to those used in heavy oil steamflood oil fields, however, would be that the steam generators would be designed to fire either natural gas (if economically available), light oil, or a mixture thereof. An advantage of using light oil produced by the hydroconversion in the steam generators would be that the light oil could have low levels of sulfur (e.g., less than or equal to about 500 ppm) or could be sulfur-free, thus minimizing environmental concerns. Fuel choice flexibility is an important economic consideration, as availability and cost of natural gas cannot be reliably predicted.

With regard to environment concerns, the burning of low value, high sulfur containing oils creates sulfur dioxide. Sulfur dioxide can react with atmospheric water and oxygen to produce sulfuric acid. Sulfuric acid is a component of acid rain, which lowers the pH of soil and freshwater bodies, resulting in substantial damage to the natural environment and chemical weathering of statues and structures. Accordingly, fuel standards increasingly require sulfur to be extracted from fossil fuels. In an embodiment of the presently disclosed process, steam is produced using light oil having a sulfur content of less than or equal to about 500 ppm, or sulfur-free light oil, thereby reducing such environment concerns.

Further, a method for transporting bitumen from oil sands reserves comprises blending bitumen extracted from the oil sands reserves and light oil to form a transport blend and transporting the transport blend. The light oil comprises hydrocarbons boiling in the range of about $C_5$ to about 800° F. The transport blend can comprise about 50-60 volume % bitumen and about 40-50 volume % light oil. Transporting can comprise transporting via pipeline.

Additionally, a transport blend for transporting bitumen from oil sands reserves comprises about 50-60 volume % bitumen extracted from the oil sands reserves and about 40-50 volume % light oil. The light oil comprises hydrocarbons boiling in the range of about $C_5$ to about 800° F.

Also, an integrated process for extracting and refining bitumen comprises hydroconverting bitumen in a reactor to provide valuable products and light oil by-product. The light oil by-product is separated from the valuable products. The light oil is transported to oil sands reserves. Steam is produced in steam generators at the oil sands reserves using a portion of the light oil transported to the oil sands reserves. Bitumen is extracted from the oil sands reserves using steam produced in the steam generators. Bitumen extracted from the oil sands reserves and a portion of the light oil transported to the oil sands reserves are blended to form a transport blend. The transport blend is transported to the reactor.

Using the light oil provided by hydroconversion of the bitumen in an integrated manner to produce steam, which is used to extract bitumen from the oil sands reserves, and to transport bitumen from the oil sands reserves to the hydroconversion reactor reduces or potentially eliminates the need to burn natural gas to produce steam. Accordingly, the presently disclosed integrated process is efficient, as well as provides economic and environmental advantages.

In an embodiment, the hydroconversion reactor is at a location remote from the oil sands reserves; in particular, the reactor and oil sands reserves can be separated by at least about 50 miles, for example, about several hundred miles. The integrated process can further comprise hydroconverting the bitumen in the transport blend in the reactor. The bitumen and the light oil in the transport blend can be separated prior to hydroconverting the bitumen in the reactor. The hydroconverting can comprise reacting a slurry of catalyst in the bitumen or the hydroconverting can comprise LC-Fining or coking, following by hydrotreating.

Many modifications of the exemplary embodiments disclosed herein will readily occur to those of skill in the art. Accordingly, the present disclosure is to be construed as including all structure and methods that fall within the scope of the appended claims.

What is claimed is:

1. A process for extracting bitumen from oil sands reserves, the process comprising:

producing steam in steam generators at the oil sands reserves using light oil comprising hydrocarbons boiling in the range of about $C_5$ to about 800° F. and having a sulfur content of 500 ppm or less, wherein the light oil is produced off-site by hydroconversion of the bitumen from the oil sands reserves at an off-site location of at least 50 miles away from the oil sands reserves;

heating the oil sands reserves using steam produced in the steam generators;

extracting bitumen from the oil sands reserves, transporting the bitumen to the off-site location for the hydroconversion; and wherein the light oil produced off-site is transported to the oil sands reserves for at least a portion of the light oil to be used in the steam generators to produce steam for heating the oil sands reserves and for forming a blend to transport the bitumen to the off-site location.

2. The process of claim 1, wherein the bitumen comprises a heavy oil having an API gravity of 3 to 15.

3. The process of claim 1, wherein the bitumen does not flow at room temperature.

4. The process of claim 1, wherein at least a portion of the light oil is produced during hydroconversion of bitumen.

5. The process of claim 4, wherein the hydroconversion comprises reaction of a slurry of catalyst in the bitumen.

6. The process of claim 1, wherein the light oil comprises one or more fractions selected from the group consisting of naphtha, kerosene, diesel, and light vacuum gasoil.

7. The process of claim 1, wherein the light oil comprises greater than or equal to about 80 weight % hydrocarbons boiling in the range of about $C_5$ to about 650° F.

8. The process of claim 1, wherein the light oil is sulfur-free.

9. A method for transporting bitumen from oil sands reserves, the method comprising:

blending bitumen extracted from the oil sands reserves and light oil to form a transport blend containing about 50-60 volume % bitumen and about 40-50 volume % light oil, wherein the light oil comprises hydrocarbons boiling in the range of about $C_5$ to about 800° F. and having a sulfur content of 500 ppm or less, and the light oil is produced by hydroconversion of the bitumen from the oil sands reserves at a location of at least 50 miles away from the oil sands reserves; and transporting the transport blend;

wherein the bitumen is extracted using steam produced from steam generators using a portion of the light oil produced by hydroconversion off-site from the oil sands reserve at least 50 miles away from the oil sands reserves, and wherein the light oil is transported to the oil sand reserves for a portion of the light oil to be used in the steam generators and for forming the transport blend.

10. The method of claim 9, wherein transporting comprises transporting via pipeline.

11. An integrated process for extracting and refining bitumen from oil sands reserves, the process comprising:

hydroconverting bitumen in a reactor at an off-site location of at least 50 miles away from the oil sands reserves to provide valuable products and a light oil by-product, wherein the light oil comprises hydrocarbons boiling in the range of about $C_5$ to about 800° F. and having a sulfur content of 500 ppm or less;

separating the light oil by-product from the valuable products;

transporting the light oil produced off-site to oil sands reserves;

producing steam in steam generators at the oil sands reserves using a portion of the light oil produced off-site and transported to the oil sands reserves;

extracting bitumen from the oil sands reserves using steam produced in the steam generators;

blending bitumen extracted from the oil sands reserves and a portion of the light oil transported to the oil sands reserves to form a transport blend; and transporting the transport blend to the reactor at a location of at least 50 miles away from the oil sands reserves for the hydroconverting.

12. The integrated process of claim 11, wherein the light oil comprises:

hydrocarbons boiling in the range of about $C_5$ to about 800° F.;

greater than or equal to about 80 weight % hydrocarbons boiling in the range of about $C_5$ to about 650° F.; and less than or equal to about 500 ppm sulfur.

13. The integrated process of claim 11, wherein the bitumen:

comprises a heavy oil having an API gravity of 3 to 15; and does not flow at room temperature.

14. The integrated process of claim 11, wherein the reactor and oil sands reserves are separated by at least about 50 miles.

15. The integrated process of claim 11, further comprising hydroconverting the bitumen in the transport blend in the reactor.

16. The integrated process of claim 15, further comprising separating the bitumen and the light oil in the transport blend prior to hydroconverting the bitumen in the reactor.

17. The integrated process of claim 11, wherein the hydroconverting is performed by a process selected from the group consisting of reacting a slurry of catalyst in the bitumen, LC-Fining followed by hydrotreating, and coking followed by hydrotreating.

* * * * *